US011820591B2

(12) United States Patent
Berry et al.

(10) Patent No.: US 11,820,591 B2
(45) Date of Patent: Nov. 21, 2023

(54) SANITARY WASTE DISPOSAL DEVICE

(71) Applicants: Woodrow Berry, Mt. Vernon, NY (US); Stacy Berry, Mt. Vernon, NY (US)

(72) Inventors: Woodrow Berry, Mt. Vernon, NY (US); Stacy Berry, Mt. Vernon, NY (US)

( * ) Notice: Subject to any disclaimer, the term of this patent is extended or adjusted under 35 U.S.C. 154(b) by 44 days.

(21) Appl. No.: 17/565,633

(22) Filed: Dec. 30, 2021

(65) Prior Publication Data

US 2023/0211945 A1 Jul. 6, 2023

(51) Int. Cl.

| | |
|---|---|
| ***B65D 30/20*** | (2006.01) |
| ***B65F 1/16*** | (2006.01) |
| ***B65F 1/14*** | (2006.01) |

(52) U.S. Cl.

CPC ..... *B65F 1/1646* (2013.01); *B65F 1/1452* (2013.01); *B65F 2250/108* (2013.01)

(58) Field of Classification Search

CPC ..... B65F 1/002; B65F 1/0006; B65F 1/06; B65F 1/0013; B65F 1/1415; B65F 2250/108; B65D 33/12; B65D 33/14; B65D 75/5838; B65D 31/04; B65D 31/10

USPC ..... 206/581; 383/38, 39

See application file for complete search history.

(56) References Cited

U.S. PATENT DOCUMENTS

| | | | | |
|---|---|---|---|---|
| 3,471,871 | A * | 10/1969 | Nociti | A61F 5/44 383/7 |
| D330,427 | S | 10/1992 | Meijer | |
| 5,725,310 | A * | 3/1998 | Kruczko | B65F 1/00 383/86.2 |
| 6,113,267 | A * | 9/2000 | Roy | B65D 33/12 383/14 |
| 6,324,704 | B1 | 12/2001 | Imo | |
| 7,749,209 | B1 | 7/2010 | Vuckovic | |
| 8,104,960 | B2 | 1/2012 | Gill | |
| 2010/0094238 | A1 | 4/2010 | Scarano | |
| 2012/0330265 | A1 | 12/2012 | Germanow | |
| 2017/0027773 | A1 | 2/2017 | Morgan | |
| 2018/0346173 | A1 * | 12/2018 | Mayer | B65B 67/1233 |

FOREIGN PATENT DOCUMENTS

WO WO2007050928 5/2007

* cited by examiner

*Primary Examiner* — King M Chu

(57) ABSTRACT

A sanitary waste disposal device for portable use includes a shell, which defines an interior space and which is substantially impermeable to water. An opening is positioned in a front of the shell proximate to a top of the shell. A cover panel is hingedly engaged to the shell proximate to the opening. The cover panel is hingable from a first position, wherein the cover panel closes the opening, to a second position, wherein waste is insertable through the opening into the shell. A mounting element is engaged to the shell proximate to the top and is used to selectively mount the shell to a substrate.

16 Claims, 7 Drawing Sheets

SANITARY WASTE DISPOSAL DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to waste disposal devices and more particularly pertains to a new waste disposal device for portable use. The present invention discloses a waste disposal device comprising a water impermeable bag having a mounting element, a resealable opening, and exterior pockets for holding personal hygiene items.

(2) Description of Related Art Including Information Disclosed Under 37 CFR 1.97 and 1.98

The prior art relates to waste disposal devices, which may comprise sealable bags and envelopes for biological waste. What is lacking in the prior art is a waste disposal device comprising a water impermeable bag having a mounting element, a resealable opening, and exterior pockets for holding personal hygiene items.

BRIEF SUMMARY OF THE INVENTION

An embodiment of the disclosure meets the needs presented above by generally comprising a shell, which defines an interior space and which is substantially impermeable to water. An opening is positioned in a front of the shell proximate to a top of the shell. A cover panel is hingedly engaged to the shell proximate to the opening. The cover panel is hingable from a first position, wherein the cover panel closes the opening, to a second position, wherein the opening is configured for insertion of waste into the shell. A mounting element is engaged to the shell proximate to the top. The mounting element is configured to selectively mount the shell to a substrate.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
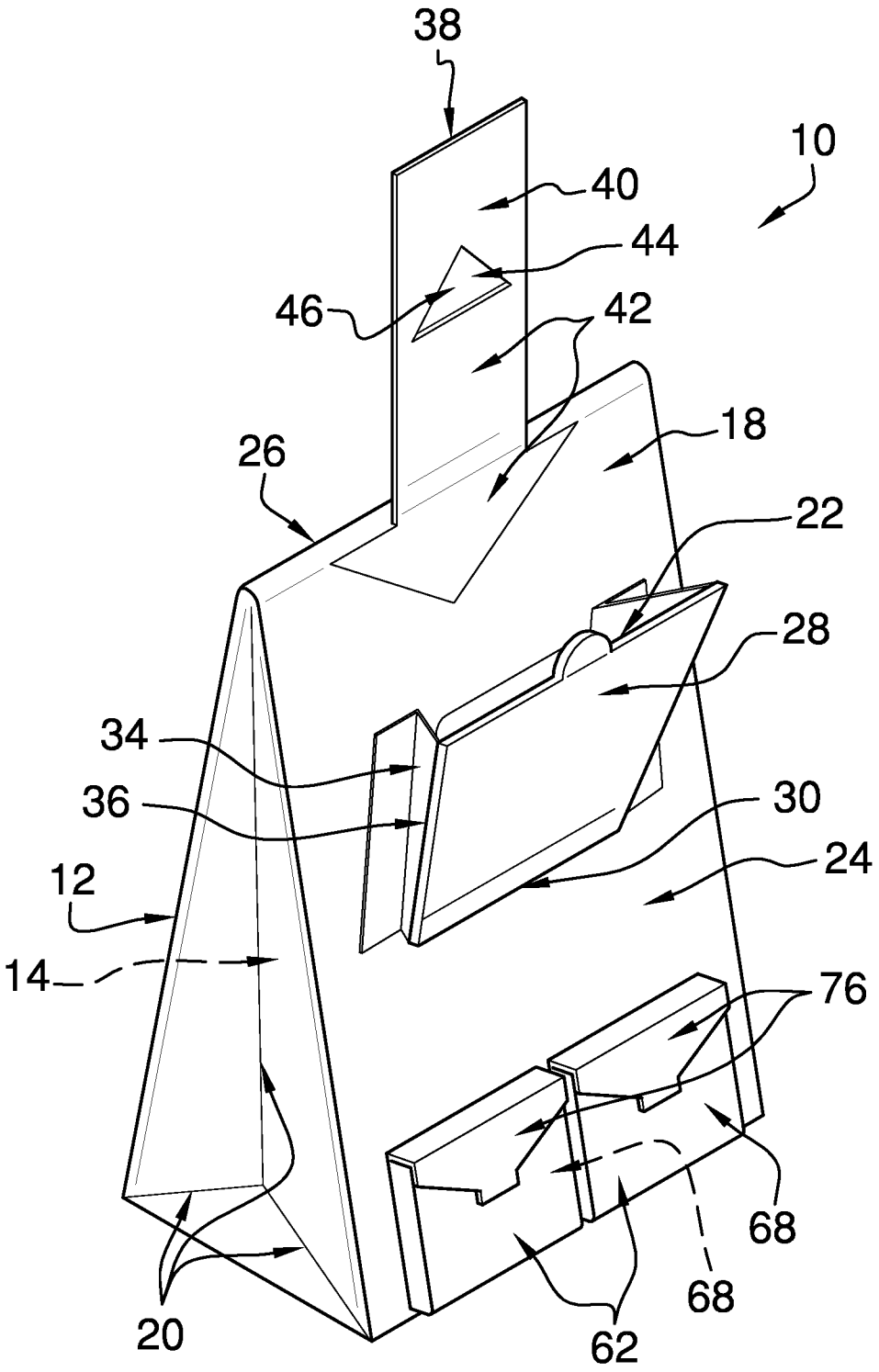
FIG. 1 is an isometric perspective view of a sanitary waste disposal device according to an embodiment of the disclosure.

With reference now to the drawings, and in particular to FIGS. 1 through 7 thereof, a new waste disposal device embodying the principles and concepts of an embodiment of the disclosure and generally designated by the reference numeral 10 will be described.

Figure 2:
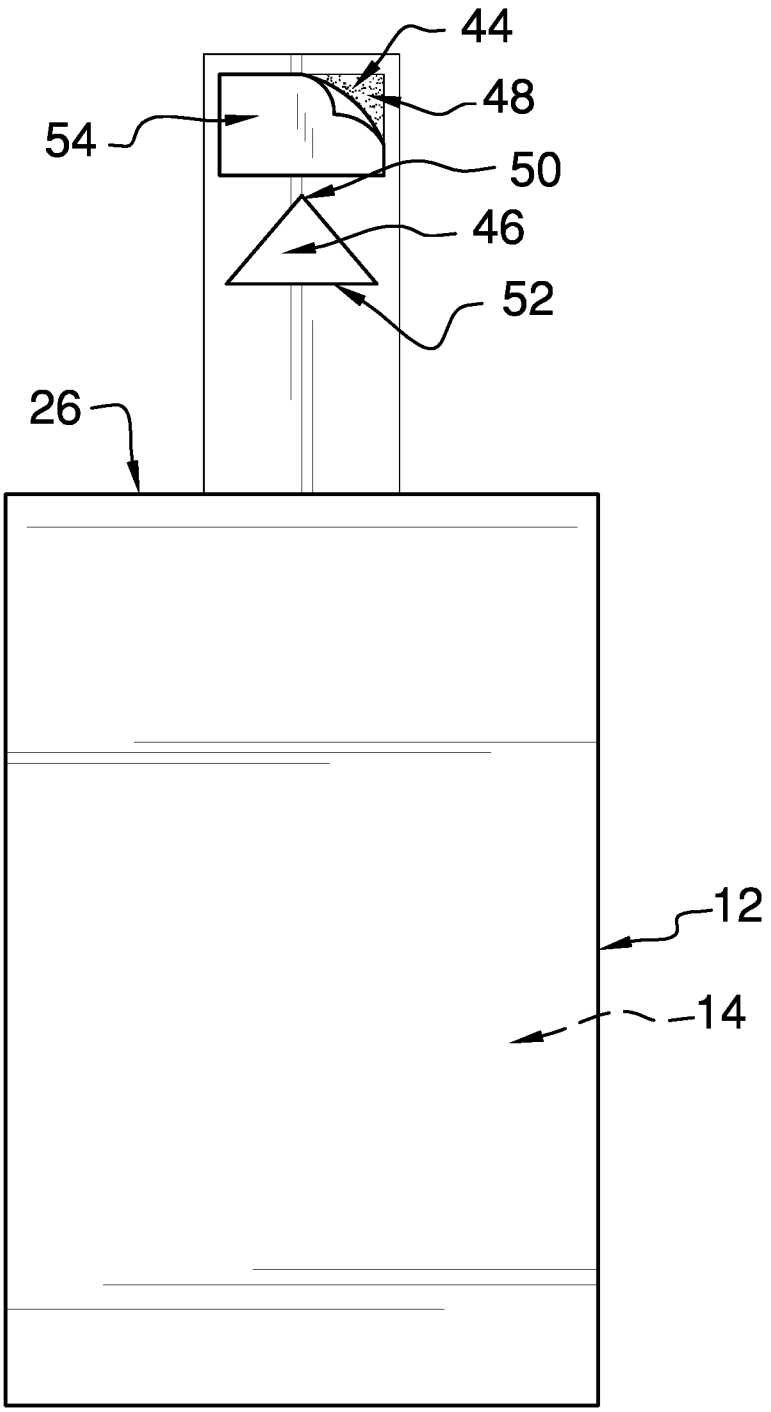
FIG. 2 is a rear view of an embodiment of the disclosure.
Figure 3:
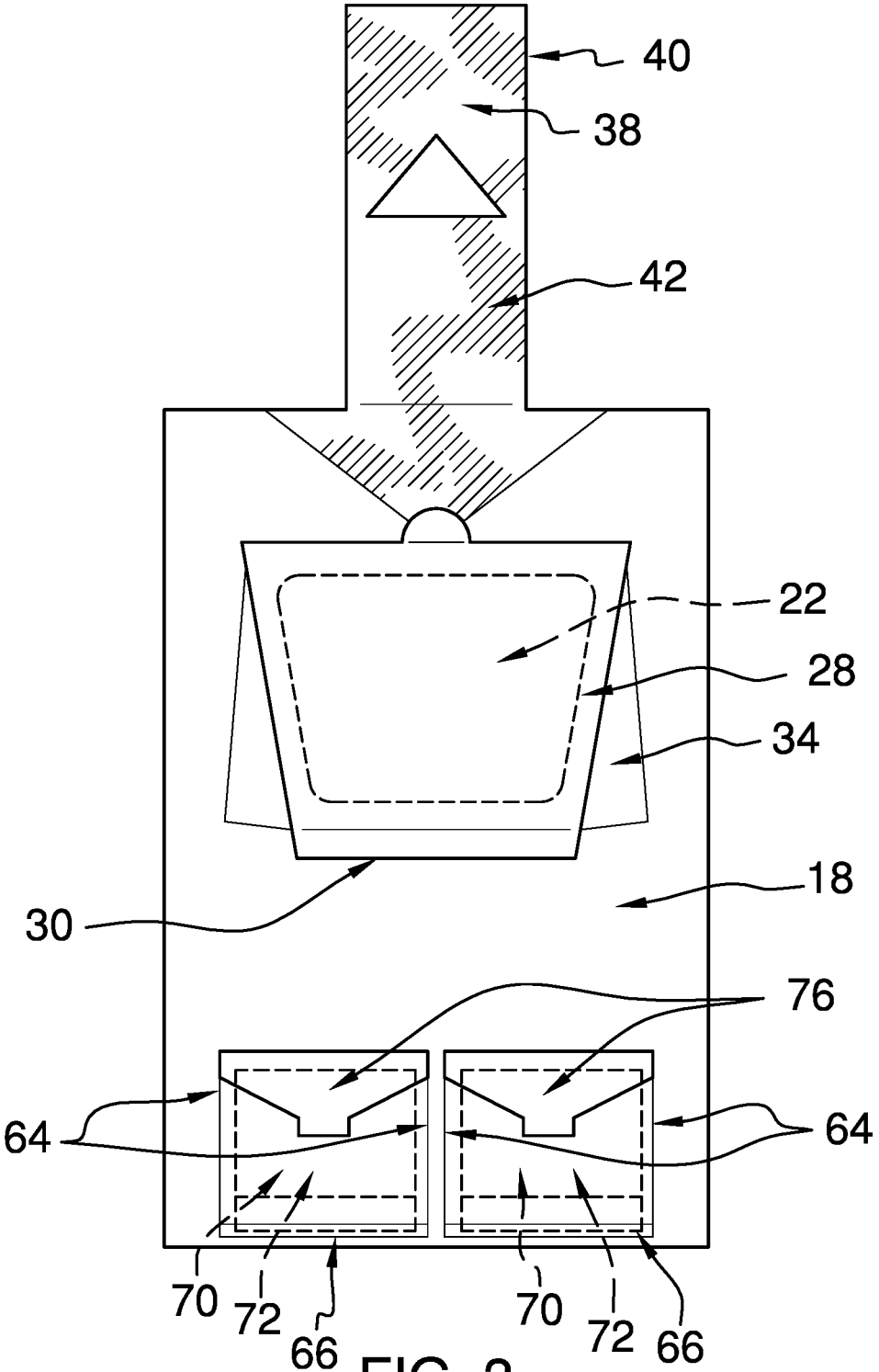
FIG. 3 is a front view of an embodiment of the disclosure.

As best illustrated in FIGS. 1 through 7, the sanitary waste disposal device 10 generally comprises a shell 12, which defines an interior space 14 and which is substantially impermeable to water. The shell 12 comprises an inner layer 16 and an outer layer 18. The inner layer 16 comprises elastomer so that the inner layer 16 is resiliently flexible and substantially impermeable to water. The outer layer 18 comprises paper stock or elastomer so that the outer layer 18 is semirigid and foldable. A plurality of pleats 20 is positioned in the shell 12 so that the shell 12 is selectively deployable from a stowed configuration to an extended configuration. In the stowed configuration, as shown in FIG. 3, the shell 12 is substantially two dimensional. In the extended configuration, as shown in FIG. 1 the shell 12 is three dimensional.

Figure 4:
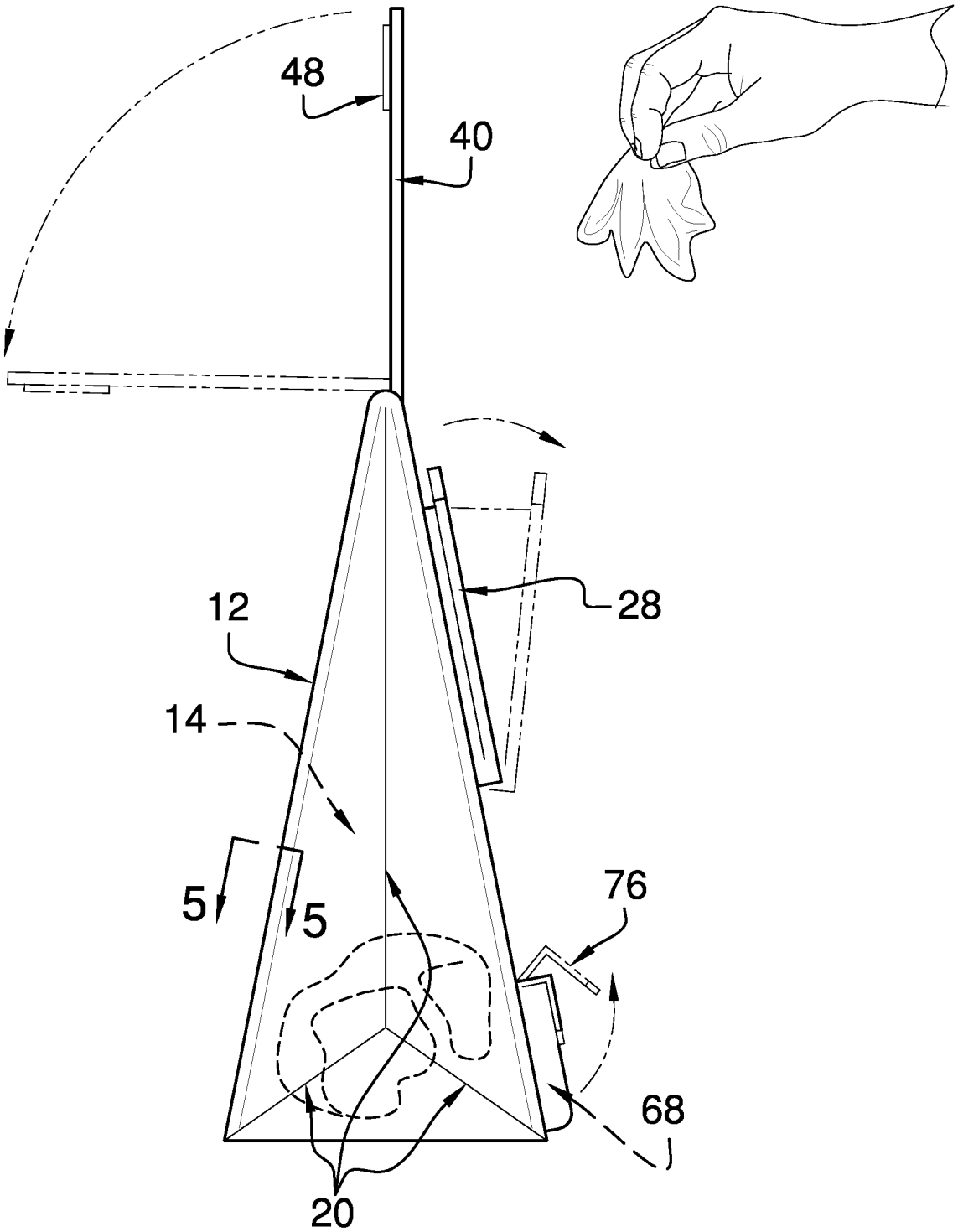
FIG. 4 is an in-use view of an embodiment of the disclosure.
Figure 5:
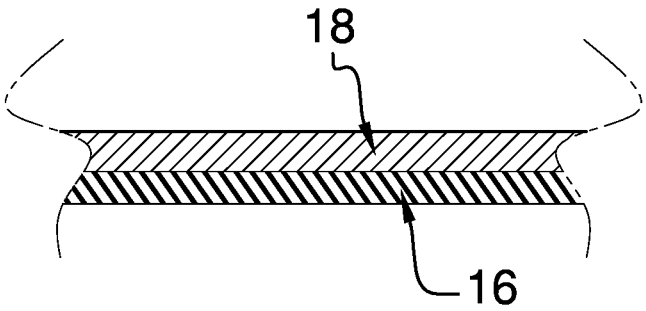
FIG. 5 is a cross-sectional view of an embodiment of the disclosure.

An opening 22 is positioned in a front 24 of the shell 12 proximate to a top 26 of the shell 12. A cover panel 28 is hingedly engaged to the shell 12 proximate to the opening 22. As shown in FIG. 4, the cover panel 28 is hingable from a first position, wherein the cover panel 28 closes the opening 22, to a second position, wherein the opening 22 is configured for insertion of waste into the shell 12. The cover panel 28 is configured to selectively engage the shell 12 to reclose the opening 22. The cover panel 28 may be engageable to the shell 12 by means known to those skilled in the art of reversible closures, such as, but not limited to, pressures sensitive adhesives, hook and loop fasteners, and the like.

Figure 6:
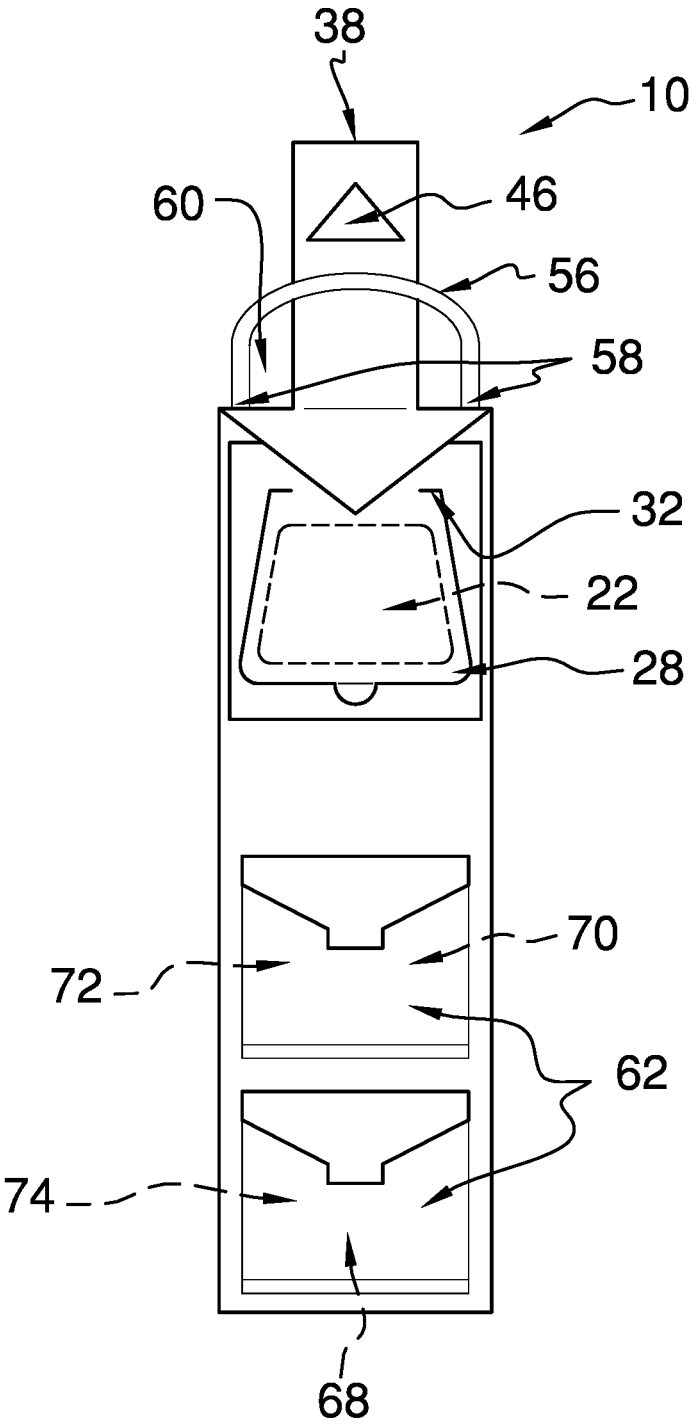
FIG. 6 is a front view of an embodiment of the disclosure.

The cover panel 28 is hingedly engaged to the shell 12 by either of a lower edge 30, as shown in FIG. 4, or an upper edge 32, as shown in FIG. 6. The cover panel 28 thus is hingable either downwardly or upwardly, respectively, to open the opening 22. Each of a pair of side flaps 34 is hingedly engaged to and extends between a respective opposed edge 36 of the cover panel 28 and the shell 12, as shown in FIG. 1.

A mounting element 38 is engaged to the shell 12 proximate to the top 26. The mounting element 38 is configured to selectively mount the shell 12 to a substrate, such as an interior element of a vehicle. The mounting element 38 comprises a tab 40, which is engaged to and which extends from the shell 12. As shown in FIG. 3, the tab 40 is shaped as an arrow 42 that points to the opening 22. A fastener 44 is engaged to the tab 40 and is configured to selectively engage the substrate so that the shell 12 hangs from the tab 40.

The fastener 44 comprises one or more of an aperture 46, which is positioned in the tab 40, and an adhesive 48, which is engaged to the tab 40. The aperture 46 is configured for insertion of a protrusion engaged to the substrate, such as a drawer knob, to hang the shell 12 from the protrusion. The aperture 46 has an upper end 50 and a lower end 52, with the lower end 52 being dimensionally wider than the upper end 50. The lower end 52 being dimensionally wider than the upper end 50 allows a variety of protrusions to be inserted into the aperture 46 and for frictional engagement of the tab to the protrusion. The aperture 46 may be triangular.

The adhesive 48 is configured to adhesively engage the substrate to engage the shell 12 to the substrate, such as a countertop, mirror, or the like. A sheet 54 is removably engaged to the adhesive 48, as shown in FIG. 2, and is configured to prevent inadvertent adhesion of the adhesive 48.

Figure 7:
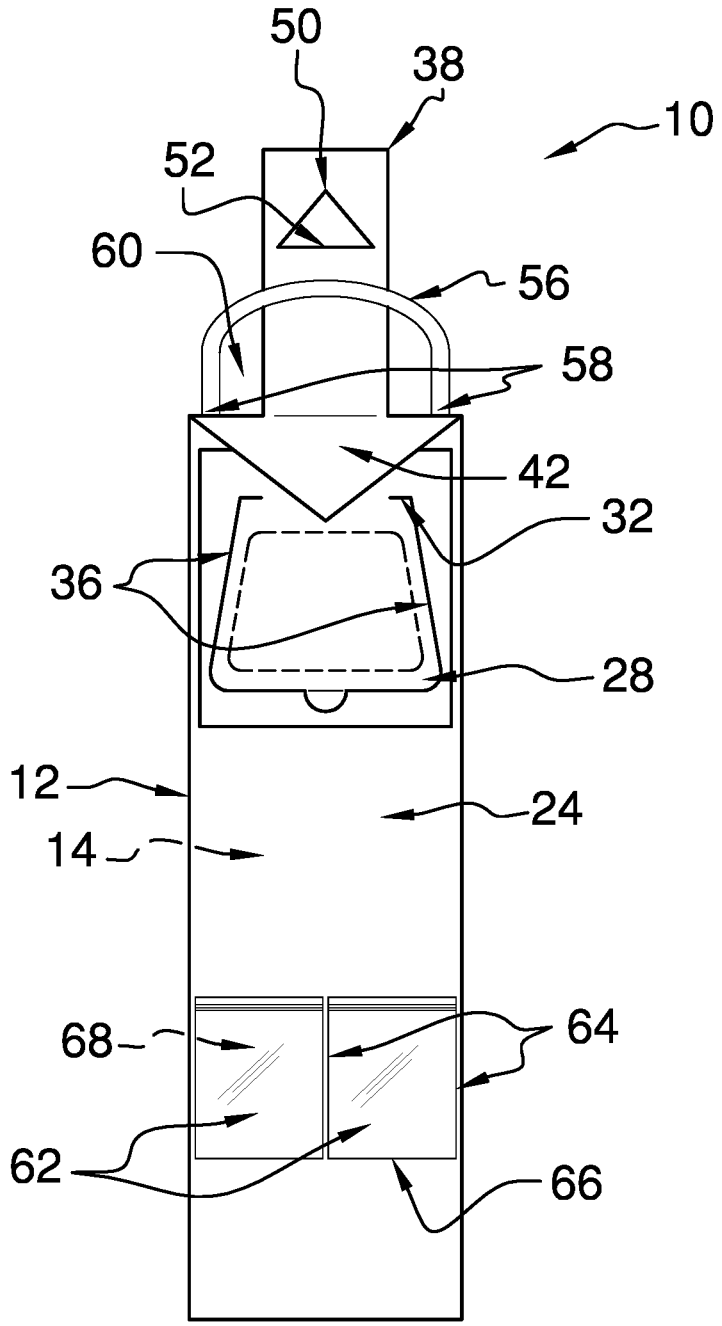
FIG. 7 is a front view of an embodiment of the disclosure.

As shown in FIGS. 6 and 7, the present invention also anticipates a cord 56, which has opposed ends 58 that are engaged to the top 26 of the shell 12 so that the cord 56 defines a loop 60. The loop 60 is configured for insertion of the protrusion engaged to the substrate to hang the shell 12 from the protrusion.

Each of a set of pouch panels 62 has opposing sides 64 and a lower limit 66 that are engaged to the shell 12 so that the pouch panel 62 defines a pocket 68. The pocket 68 is configured for insertion of a personal hygiene item 70, such as a packet of tissues 72 or a plurality of wet wipes 74. Each of a set of flap panels 76 is hingedly engaged to the shell 12 proximate to a respective pouch panel 62. The flap panel 76 is selectively engageable to the respective pouch panel 62 to close an associated pocket 68. The flap panel 76 is engageable to the shell 12 by means known to those skilled in the art of reversible closures, such as, but not limited to, pressures sensitive adhesives, hook and loop fasteners, magnets, and the like. The set of pouch panels 62 may comprise two pouch panels 62 engaged to the front 24 of the shell 12 below the opening 22, as shown in FIGS. 1, 6, and 7, although the present invention anticipates the set of pouch panels 62 comprising other numbers of pouch panels 62 and being arranged in a variety of configurations.

In use, a packet of tissues 72 is positioned in one of the pockets 68 and a plurality of wet wipes 74 is positioned in the other of the pockets 68. The plurality of pleats 20 is used to deploy the shell 12 to the expanded configuration. The shell 12 then is mounted to the substrate using one or more of the aperture 46 and the adhesive 48, or the cord 56. The cover panel 28 then is opened as needed to insert waste into the interior space 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A sanitary waste disposal device comprising:

a shell defining an interior space, the shell being substantially impermeable to water;

an opening positioned in a front of the shell proximate to a top of the shell;

a cover panel hingedly engaged to the shell proximate to the opening, such that the cover panel is hingable from a first position, wherein the cover panel closes the opening, to a second position, wherein the opening is configured for insertion of waste into the shell;

a mounting element engaged to the shell proximate to the top, wherein the mounting element is configured for selectively mounting the shell to a substrate; and a pair of side flaps, each side flap being hingedly engaged to and extending between a respective opposed edge of the cover panel and the shell.

2. The sanitary waste disposal device of claim 1, wherein the shell comprises:

an inner layer comprising elastomer such that the inner layer is resiliently flexible and substantially impermeable to water; and an outer layer comprising paper stock or elastomer, such that the outer layer is semirigid and foldable.

3. The sanitary waste disposal device of claim 2, further including a plurality of pleats positioned in the shell, such that the shell is selectively deployable from a stowed configuration, wherein the shell is substantially two dimensional, to an extended configuration, wherein the shell is three dimensional.

4. The sanitary waste disposal device of claim 1, wherein the cover panel is configured for selectively engaging the shell for reclosing the opening.

5. The sanitary waste disposal device of claim 1, wherein the cover panel is hingedly engaged by either of a lower edge or an upper edge to the shell, such that the cover panel is hingable either downwardly or upwardly, respectively, for opening the opening.

6. A sanitary waste disposal device comprising:

a shell defining an interior space, the shell being substantially impermeable to water;

an opening positioned in a front of the shell proximate to a top of the shell;

a cover panel hingedly engaged to the shell proximate to the opening, such that the cover panel is hingable from a first position, wherein the cover panel closes the opening, to a second position, wherein the opening is configured for insertion of waste into the shell;

a mounting element engaged to the shell proximate to the top, wherein the mounting element is configured for selectively mounting the shell to a substrate;

a set of pouch panels, each pouch panel having opposing sides and a lower limit engaged to the shell, such that the pouch panel defines a pocket, wherein the pocket is configured for insertion of a personal hygiene item; and a set of flap panels, each flap panel being hingedly engaged to the shell proximate to a respective pouch panel, the flap panel being selectively engageable to the respective pouch panel for closing an associated pocket.

7. The sanitary waste disposal device of claim 6, wherein the set of pouch panels comprises two pouch panels engaged to the front of the shell below the opening.

8. The sanitary waste disposal device of claim 1, wherein the mounting element comprises:

a tab engaged to and extending from the shell; and a fastener engaged to the tab and being configured for selectively engaging the substrate, such that the shell hangs from the tab.

9. The sanitary waste disposal device of claim 1, further comprising:

the shell comprising:

an inner layer comprising elastomer such that the inner layer is resiliently flexible and substantially impermeable to water, and an outer layer comprising paper stock or elastomer, such that the outer layer is semirigid and foldable;

a plurality of pleats positioned in the shell, such that the shell is selectively deployable from a stowed configuration, wherein the shell is substantially two dimensional, to an extended configuration, wherein the shell is three dimensional;

the cover panel being configured for selectively engaging the shell for reclosing the opening, the cover panel being hingedly engaged by either of a tower edge or an upper edge to the shell, such that the cover panel is hingable either downwardly or upwardly, respectively, for opening the opening;

a set of pouch panels, each pouch panel having opposing sides and a lower limit engaged to the shell, such that the pouch panel defines a pocket, wherein the pocket is configured for insertion of a personal hygiene item, the set of pouch panels comprising two pouch panels engaged to the front of the shell below the opening;

a set of flap panels, each flap panel being hingedly engaged to the shell proximate to a respective pouch panel, the flap panel being selectively engageable to the respective pouch panel for closing an associated pocket;

the mounting element comprising:

a tab engaged to and extending from the shell, the tab being shaped as an arrow pointing to the opening, a fastener engaged to the tab and being configured for selectively engaging the substrate, such that the shell hangs from the tab, the fastener comprising one or more of an aperture positioned in the tab and an adhesive engaged to the tab, wherein the aperture is configured for insertion of a protrusion engaged to the substrate for hanging the shell from the protrusion, wherein the adhesive is configured for adhesively engaging the substrate for engaging the shell to the substrate, the aperture having an upper end and a lower end, the lower end being dimensionally wider than the upper end, the aperture being triangular, and a sheet removably engaged to the adhesive, wherein the sheet is configured for preventing inadvertent adhesion of the adhesive; and a cord having opposed ends engaged to the top of the shell, such that the cord defines a loop, wherein the loop is configured for insertion of the protrusion engaged to the substrate for hanging the shell from the protrusion.

10. A sanitary waste disposal device comprising:

a shell defining an interior space, the shell being substantially impermeable to water;

an opening positioned in a front of the shell proximate to a top of the shell;

a cover panel hingedly engaged to the shell proximate to the opening, such that the cover panel is hingable from a first position, wherein the cover panel closes the opening, to a second position, wherein the opening is configured for insertion of waste into the shell;

a mounting element engaged to the shell proximate to the top, wherein the mounting element is configured for selectively mounting the shell to a substrate;

wherein the mounting element comprises a tab engaged to and extending from the shell, and a fastener engaged to the tab and being configured for selectively engaging the substrate, such that the shell hangs from the tab; and wherein the tab is shaped as an arrow pointing to the opening.

11. A sanitary waste disposal device comprising:

a shell defining an interior space, the shell being substantially impermeable to water;

an opening positioned in a front of the shell proximate to a top of the shell;

a cover panel hingedly engaged to the shell proximate to the opening, such that the cover panel is hingable from a first position, wherein the cover panel closes the opening, to a second position, wherein the opening is configured for insertion of waste into the shell;

a mounting element engaged to the shell proximate to the top, wherein the mounting element is configured for selectively mounting the shell to a substrate;

wherein the mounting element comprises a tab engaged to and extending from the shell, and a fastener engaged to the tab and being configured for selectively engaging the substrate, such that the shell hangs from the tab; and wherein the fastener comprises one or more of an aperture positioned in the tab and an adhesive engaged to the tab, wherein the aperture is configured for insertion of a protrusion engaged to the substrate for hanging the shell from the protrusion, wherein the adhesive is configured for adhesively engaging the substrate for engaging the shell to the substrate.

12. The sanitary waste disposal device of claim 11, wherein the aperture has an upper end and a lower end, the lower end being dimensionally wider than the upper end.

13. The sanitary waste disposal device of claim 12, wherein the aperture is triangular.

14. The sanitary waste disposal device of claim 11, further including a sheet removably engaged to the adhesive, wherein the sheet is configured for preventing inadvertent adhesion of the adhesive.

15. The sanitary waste disposal device of claim 1, further including a cord having opposed ends engaged to the top of the shell, such that the cord defines a loop, wherein the loop is configured for insertion of a protrusion engaged to the substrate for hanging the shell from the protrusion.

16. A sanitary waste disposal system comprising:

a shell defining an interior space, the shell being substantially impermeable to water;

an opening positioned in a front of the shell proximate to a top of the shell;

a cover panel hingedly engaged to the shell proximate to the opening, such that the cover panel is hingable from a first position, wherein the cover panel closes the opening, to a second position, wherein the opening is configured for insertion of waste into the shell;

a mounting element engaged to the shell proximate to the top, wherein the mounting element is configured for selectively mounting the shell to a substrate;

a pair of pouch panels, each pouch panel having opposing sides and a lower limit engaged to the shell, such that the pouch panel defines a pocket;

a packet of tissues positioned in one of the pockets;

a plurality of wet wipes positioned in the other of the pockets; and a pair of flap panels, each flap panel being hingedly engaged to the shell proximate to a respective pouch panel, the flap panel being selectively engageable to the respective pouch panel for closing an associated pocket.

* * * * *